US009044976B2

(12) United States Patent
Kawakami et al.

(10) Patent No.: US 9,044,976 B2
(45) **Date of Patent: *Jun. 2, 2015**

(54) PLATEN UNIT AND LIQUID EJECTING APPARATUS

(71) Applicant: SEIKO EPSON CORPORATION, Tokyo (JP)

(72) Inventors: Takayuki Kawakami, Matsumoto (JP); Takao Yamamoto, Shiojiri (JP); Satoru Kobayashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/048,319

(22) Filed: Oct. 8, 2013

(65) Prior Publication Data

US 2014/0036018 A1 Feb. 6, 2014

Related U.S. Application Data

(63) Continuation of application No. 13/494,471, filed on Jun. 12, 2012, now Pat. No. 8,550,618.

(30) Foreign Application Priority Data

Jun. 20, 2011 (JP) ..... 2011-136564

(51) Int. Cl.

| | |
|---|---|
| ***B41J 2/01*** | (2006.01) |
| ***B41J 13/10*** | (2006.01) |
| ***B41J 11/02*** | (2006.01) |

(52) U.S. Cl.

CPC . *B41J 13/10* (2013.01); *B41J 11/02* (2013.01)

(58) Field of Classification Search

None

See application file for complete search history.

(56) References Cited

U.S. PATENT DOCUMENTS

| | | | | |
|---|---|---|---|---|
| 6,419,411 | B1 | 7/2002 | Tanno | |
| 8,277,041 | B2 | 10/2012 | Yamamoto | |
| 8,550,618 | B2 * | 10/2013 | Kawakami et al. | 347/105 |
| 2002/0097311 | A1 | 7/2002 | Hinojosa et al. | |

FOREIGN PATENT DOCUMENTS

| | | |
|---|---|---|
| JP | 2000-289290 | 10/2000 |
| JP | 2002-067410 | 3/2002 |
| JP | 2002-120420 | 4/2002 |
| JP | 2005-099601 | 4/2005 |
| JP | 2005-169788 | 6/2005 |
| JP | 2007-190685 | 8/2007 |
| JP | 2009-279780 | 12/2009 |
| JP | 2010-214880 | 9/2010 |

OTHER PUBLICATIONS

U.S. Appl. No. 13/494,471, Jul, 9, 2013, Notice of Allowance.

* cited by examiner

*Primary Examiner* — Lamson Nguyen

(74) *Attorney, Agent, or Firm* — Workman Nydegger

(57) ABSTRACT

A platen unit includes a supporting member that is grounded and is made of a metal, a platen supporting member that is provided on the supporting member, includes an inner space, is formed of a conductive resin, and includes a first contact point, a platen that is provided on the platen supporting member, is formed of a conductive resin, and includes a second contact point which contacts the first contact point, and a seal member that is provided between the platen supporting member and the platen.

8 Claims, 9 Drawing Sheets

PLATEN UNIT AND LIQUID EJECTING APPARATUS

This application is a continuation of U.S. application Ser. No. 13/494,471, filed Jun. 6, 2012, which claims priority to Japanese Patent Application No. 2011-136564, filed on Jun. 20, 2011, which applications are expressly incorporated by reference herein.

BACKGROUND

1. Technical Field

The present invention relates to a platen unit and a liquid ejecting apparatus.

2. Related Art

An ink jet type printer in which ink is ejected and an image is formed on a medium is used. In the ink jet type printer, a platen for supporting the medium is provided. The platen appropriately supports the medium, and therefore, a distance between a head which ejects the ink and the medium is appropriately maintained.

Since the medium is transported on the platen, at this time, static electricity may occur on the platen. According to the occurrence of the static electricity, an electric field is generated between the opposed head and the platen and paper dust particles in the electric field are polarized. The polarized paper dust particles are adsorbed on the heads, and therefore, clogging of nozzles in the head is generated. Thereby, in order to prevent the paper dust particles from being adsorbed on the head, it is preferable to make the platen be not charged.

In JP-A-2010-214880, in order to prevent mist-like liquid droplets from being adsorbed on nozzle surfaces, an electrode member which charges a substrate on which the discharged liquid is attached is disclosed. In JP-A-2000-289290, a platen which supports paper is disclosed. In JP-A-2009-279780, suppressing staining of a back surface due to waste ink by using a mesh medium unit is disclosed.

A platen supporting member for supporting a platen is provided in the lower portion of the platen. Moreover, in order to adsorb a medium from a plurality of holes which are provided in the platen, an inner space is provided in the platen supporting member. In addition, in order to improve airtightness between the platen and the platen supporting member, a seal member such as a sponge is inserted between the platen and the platen supporting member. Thereby, the platen is insulated from the platen supporting member, and it is difficult to rapidly remove electric charge due to static electricity generated on the platen.

SUMMARY

An advantage of some aspects of the invention is to rapidly remove the electric charge of the platen.

According to an aspect of the invention, there is provided a platen unit including a supporting member that is grounded and is made of a metal; a platen supporting member that is provided on the supporting member, includes an inner space, is formed of a conductive resin, and includes a first contact point; a platen that is provided on the platen supporting member, is formed of a conductive resin, and includes a second contact point which contacts the first contact point; and a seal member that is provided between the platen supporting member and the platen.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
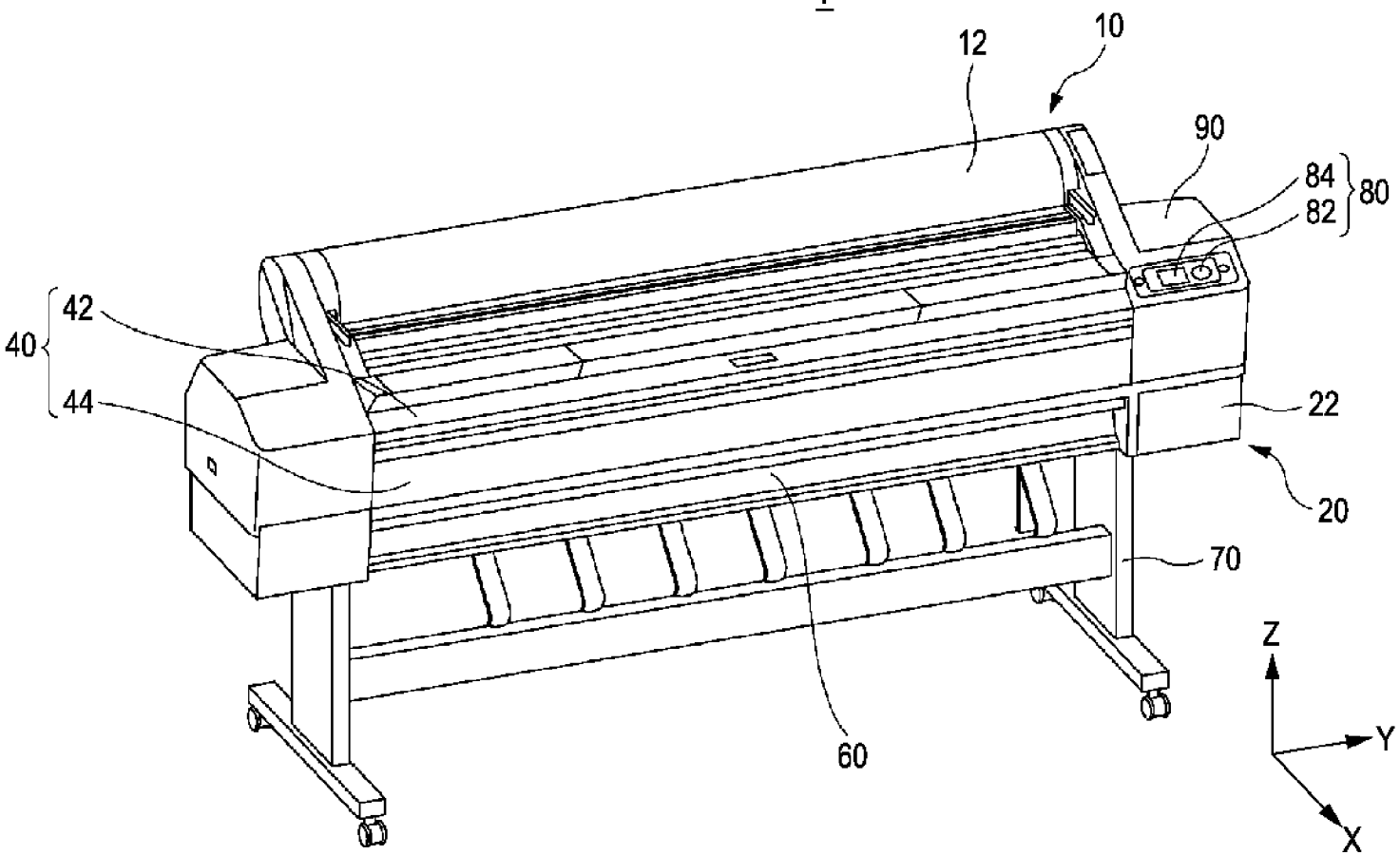
FIG. 1 is a perspective view showing an ink jet printer in the present embodiment.

According to the specification and the accompanying drawings, at least the following matters are obvious.

According to an aspect of the invention, there is provided a platen unit including a supporting member that is grounded and is made of a metal; a platen supporting member that is provided on the supporting member, includes an inner space, is formed of a conductive resin, and includes a first contact point; a platen that is provided on the platen supporting member, is formed of a conductive resin, and includes a second contact point which contacts the first contact point; and a seal member that is provided between the platen supporting member and the platen.

According to the aspect of the invention, even when a medium rubs against the platen and the platen is charged, electric charge (plus electric charge or minus electric charge) of the platen can be rapidly removed through the first contact point, the second contact point, and the supporting member (that is, the electric charge on the platen is discharged through the first contact point, the second contact point, and the supporting member). Moreover, in this way, since the electric charge on the platen is rapidly removed, an electric field is not generated between the platen and a head. Therefore, paper dust particles between the platen and the head can be suppressed from being adsorbed on nozzles of the head. In addition, occurrence of pixels in which dots are not formed, referred to as so-called dot omission, can be decreased.

In the platen unit, the seal member may be provided so as to be continuous between the platen supporting member and the platen, the first contact point may be provided so as to protrude to the outside of the platen supporting member with respect to a transport direction of a medium on the platen, and the second contact point may be provided so as to protrude to the outside of the platen with respect to the transport direction, and at least one of the first contact point and the second contact point may straddle the seal member and contact the outside of the seal member.

According to the platen unit, by the continuous seal member, the first contact point and the second contact point contact each other and the electric charge on the platen can be securely discharged while airtightness between the platen and the platen supporting member is guaranteed.

In the platen unit, an elastic protrusion may be provided in either a first engagement portion including the first contact point or a second engagement portion including the second contact point, the elastic protrusion may be deformed when the first engagement and the second engagement are engaged with each other, and the first contact point and the second contact point may contact each other.

According to the platen unit, since the elastic protrusion is elastically deformed, the first contact point and the second contact point can securely contact each other due to the pressing which is generated by the elastic deformation.

In the platen unit, the platen supporting member may include a stopping portion for contacting the supporting member in a bottom portion of the platen supporting member, and the stopping portion may be provided in a position which overlaps with a contact portion of the first contact point and the second contact point in a direction crossing the transport direction of the medium on the platen.

According to the platen unit, a distance between the stopping portion and the contact portion can be shortened, and even when a conductive resin is used, the electric charge of the platen can be rapidly discharged.

In the platen unit, the platen supporting member and the supporting member may be fastened to each other by a fastening member in the stopping portion.

According to the platen unit, the platen supporting member and the supporting member can securely contact each other in the stopping portion.

In the platen unit, both the first contact point and the second contact point may be provided at the same pitch with respect to the direction crossing the transport direction of the medium on the platen.

According to the platen unit, the contact portions of the first contact point and the second contact point are provided at the same pitch. Moreover, since a discharging path of the electric charge of the platen is uniformly distributed, the discharging can be more rapidly performed.

In the platen unit, the seal member may be a conductive sponge.

According to the platen unit, the electric charge of the platen can be released to the supporting member through not only the contact portion of the first contact point and the second contact point but also the conductive sponge.

According to another aspect of the invention, there is provided a liquid ejecting apparatus including a head that ejects liquid to a medium; a supporting member that is grounded and is made of a metal; a platen supporting member that is provided on the supporting member, includes an inner space, is formed of a conductive resin, and includes a first contact point; a platen that is provided on the platen supporting member, is formed of a conductive resin, and includes a second contact point which contacts the first contact point; and a seal member that is provided between the platen supporting member and the platen.

According to another aspect of the invention, even when a medium rubs against the platen and the platen is charged, electric charge (plus electric charge or minus electric charge) of the platen can be rapidly removed through the first contact point, the second contact point, and the supporting member (that is, the electric charge on the platen is discharged through the first contact point, the second contact point, and the supporting member). Moreover, in this way, since the electric charge on the platen is rapidly removed, an electric field is not generated between the platen and a head. Therefore, paper dust particles between the platen and the head being adsorbed on nozzles of the head can be suppressed. In addition, occurrence of pixels in which dots are not formed, referred to as so-called dot omission, can be decreased.

Embodiment

FIG. 1 is a perspective view showing an ink jet printer 1 in the present embodiment. As shown in FIG. 1, the ink jet printer 1 includes a recording portion 40 in which the longitudinal direction is horizontally disposed, a housings 90 which is mounted on an end of the recording portion 40, a loading portion 10 which is mounted on the upper portion of the recording portion 40, and legs 70 which support the recording portion 40 and the housing 90 from the lower portion.

In the inner portion of the loading portion 10, a roll assembly 11 including a roll R around which a long medium to be recorded (refer to FIG. 2; hereinafter, referred to as a "medium") is rolled and piled is mounted. However, in FIG. 1, the roll assembly 11 (refer to FIG. 2) is covered by a roll cover 12. A mechanism of the inner portion of the recording portion 40 is covered by a top cover 42 and a front cover 44. A head 41 described below (refer to FIG. 2) or the like is disposed in the inner portion of the recording portion 40, ink is ejected with respect to the medium which is unrolled from the roll R of the loading portion 10 and fed to the recording portion 40, and an image is formed.

The medium, on which the image is formed in the recording portion 40, is discharged from discharging portion 60 formed downward from the recording portion 40 to the outside. Moreover, the legs 70 are mounted so that the medium passing through the discharging portion 60 does not contact a floor surface.

The housing 90 forms a space of a home position at which the head retreated from the recording portion 40 stands by and includes a cartridge holder 20 in the lower portion. In the cartridge holder 20, an ink cartridge (not shown) which stores ink supplied to the head is mounted in the inner portion of a holder cover 22 which covers the surface of the cartridge holder.

In addition, an operation panel 80 is disposed on the upper surface of the housing 90. The operation panel 80 includes a plurality of switches 82 which are operated by a user and a display portion 84 which displays the operating state of the ink jet type recording apparatus 1. Accordingly, the side in which the operation panel 80 and the cartridge holder 20 are disposed is the front surface, and a user operates the ink jet printer 1 from the front surface side.

Figure 2:
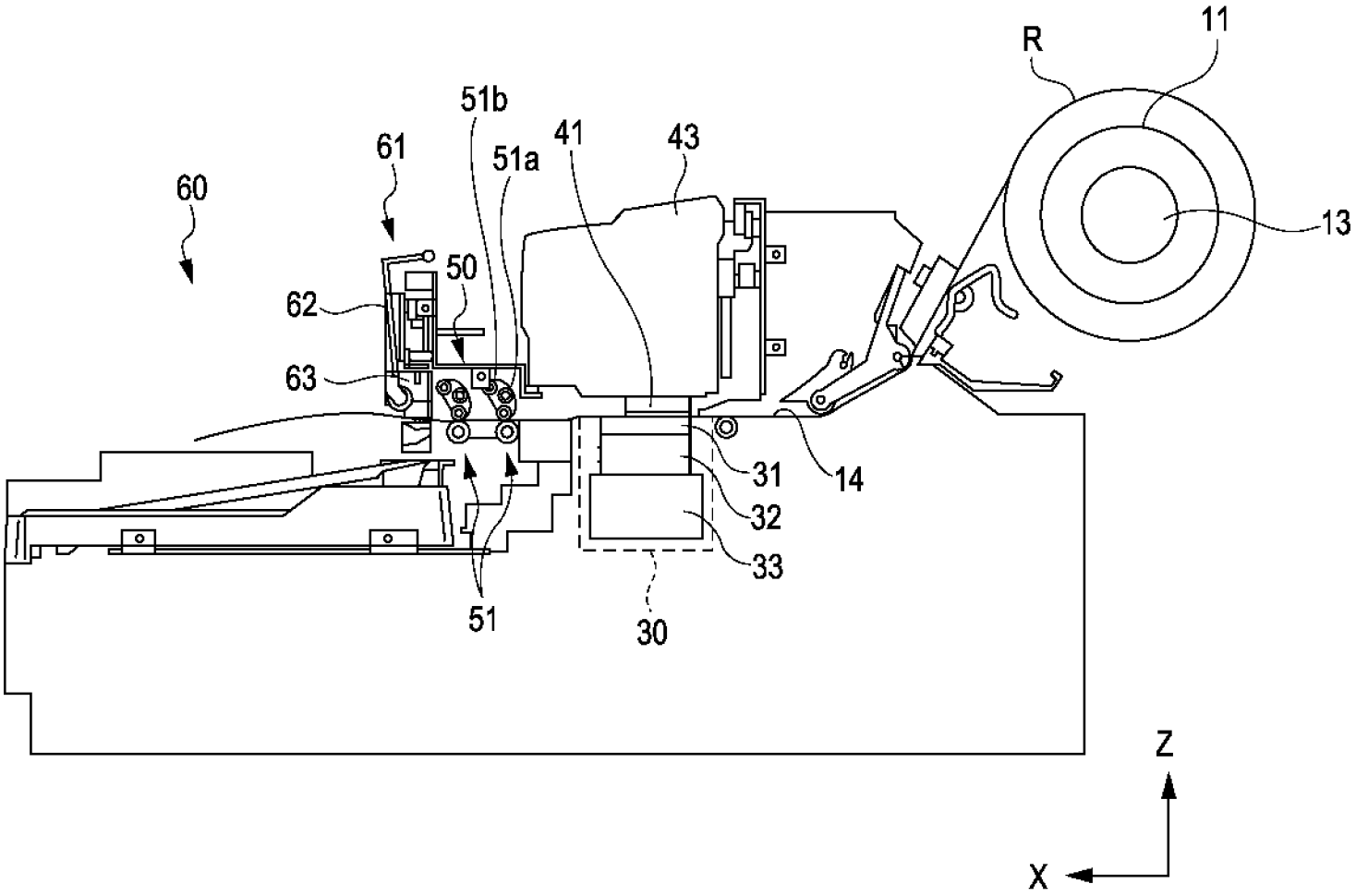
FIG. 2 is an internal side view of the ink jet printer in the embodiment.

FIG. 2 is an internal side view of the ink jet printer 1 in the embodiment.

As shown in FIG. 2, the ink jet printer 1 includes a spindle 13 which holds the roll R, a transport path 14 which transports a rolled paper R, the recording portion 40 which performs image formation with respect to the transported medium, the discharging portion 60 which discharges the medium subjected to the image formation, and a cutting device 61 which cuts the medium discharged from the discharging portion 60. In addition, the ink jet printer 1 includes a platen unit 30 which supports the transported medium in the lower portion of the head 41 described below. The platen unit 30 includes a platen 31, a platen base 32 (corresponding to a platen supporting member), and a supporting member 33. The detailed description of the platen unit 30 will be described below. Moreover, the ink jet printer 1 includes a control portion (not shown) which generally controls the operation of each of the above-described components.

In the description below, in some cases, the transport direction (discharging direction) of the medium is referred to as an X-axis direction, a width direction (a direction perpendicular to the drawing surface of FIG. 2) of the transport path 14 which is perpendicular to the X-axis direction is referred to as a Y-axis direction, and a vertical direction which is perpendicular to the X-axis direction and the Y-axis direction is referred to as a Z-axis direction.

The recording portion 40 includes the head 41 which ejects ink with respect to the medium transported along the transport path 14. The head 41 is mounted on a carriage 43 capable of moving in the width direction of the transport path 14. The head 41 includes a plurality of nozzle rows and is configured so as to eject the ink of a predetermined color (for example, yellow (Y), magenta (M), cyan (C), and black (K)) from each nozzle row. The head 41 ejects ink with respect to the recording surface of the rolled paper R which is supported by the platen 31, and therefore, the image formation which records information such as a predetermined image or character is performed.

The medium, on which the image formation is performed in the recording portion 40, is discharged from the discharging portion 60 through a nip portion 50 configuring a trailing end portion of the transport path 14. The nip portion 50 includes a plurality of discharge rollers 51 which nip the medium and discharge the medium by being rotated. The discharge roller 51 includes a mechanism which switches the roller nipping the medium to a serrated roller 51*a* or a roll roller 51*b* according to the kind of the paper.

The cutting device 61 which cuts the discharged medium to a predetermined size is provided in the downstream side of the nip portion 50. The cutting device 61 includes a regulating member 62 which regulates a height position of the discharged medium and a cutter unit 63 which moves in the width direction (Y-axis direction) perpendicular to the discharging direction (X-axis direction) of the medium and cuts the medium.

Figure 3:
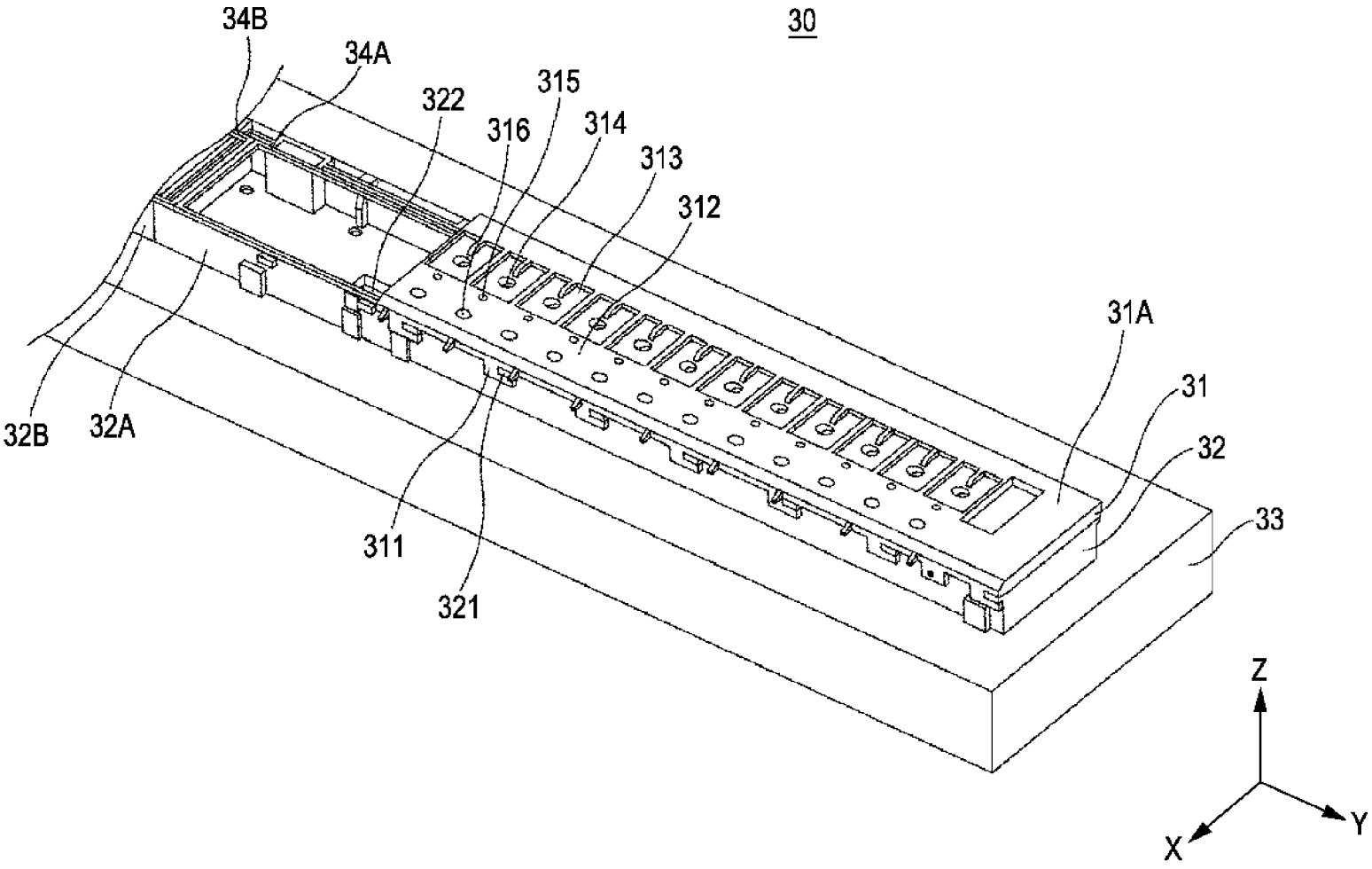
FIG. 3 is a perspective view showing a platen unit in the embodiment.

FIG. 3 is a perspective view showing the platen unit 30 in the embodiment. In FIG. 3, as the minimum configuration of the platen unit 30 of the embodiment, the platen 31, the platen base 32, and the supporting member 33 are shown. Moreover, in order to facilitate the description of the configuration of the platen unit 30, FIG. 3 perspectively shows a portion of the platen unit 30.

Figure 4:
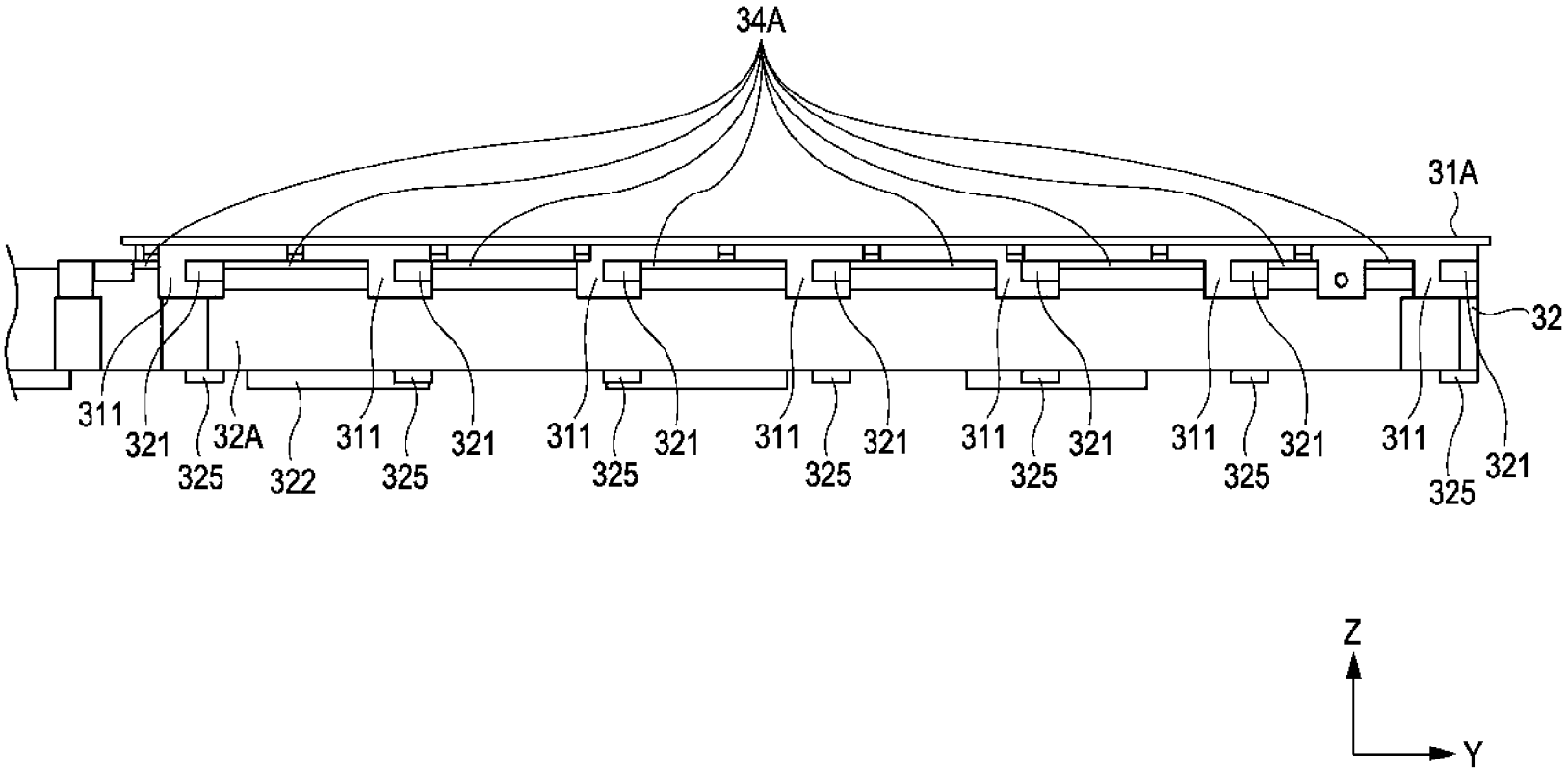
FIG. 4 is a front view showing a first platen and a first platen base in the embodiment.

FIG. 4 is a front view showing a first platen 31A and a first platen base 32A in the embodiment. The platen 31 and the platen base 32 each are configured of a plurality of members. However, here, the first platen 31A and the first platen base 32A are shown among the members. FIG. 4 is the view when the first platen 31A and the first platen base 32A are viewed from the plus side of the X-axis toward the minus side thereof in FIG. 2. However, the first platen 31A and the first platen base 32A cannot be viewed from the above angle in the state of being mounted on the ink jet printer 1. Here, for the description, a state where the first platen 31A and the first platen base 32A are removed from the ink jet printer 1 is shown.

Hereinafter, an outline of the platen unit 30 will be described with reference to the drawings. The supporting member 33 is a member for supporting the platen base 32 on the upper portion of the member. The platen base 32 includes the first platen base 32A, a second platen base 32B, and a third platen base 32C (not shown in FIG. 3).

Each of lengths of the platen bases in a paper width direction (Y direction) are different from one another, but, other configurations are substantially similar to each another. Therefore, here, the first platen base 32A is mainly described as the example. In addition, the first platen 31A, a second platen 31B, and a third platen 31C are provided on the upper portion of the first platen base 32A, the second platen base 32B, and the third platen base 32C. Each of lengths of the first platen 31A, the second platen 31B, and the third platen 31C in the paper width direction (Y direction) are different from one another, but, other configurations are substantially similar to each another. Therefore, here, the first platen 31A is mainly described as the example.

The platen 31 and the platen base 32 are injection-molded using a conductive resin. The reason why the conductive resin is used is that static electricity generated on the platen 31 can be released. Moreover, the reason why an aerial discharged resin is not used is that the aerial discharged resin is easily worn and cannot secure the height accuracy of the platen having high accuracy over the long term.

In addition, the reason why the platen 31 and the platen base 32 are not manufactured by a sheet metal material is that the steps in the punching process of the sheet metal material are increased since the shape of the platen 31 is complicated, and performing processing with high accuracy is difficult even if being manufactured by the sheet metal.

A bottom portion of the first platen base 32A includes a plurality of bottom openings 322. As shown in FIG. 4, the bottom openings 322 have a shape which protrudes from the bottom surface of the platen base 32A and is fitted to openings of the supporting member 33 (described below). Moreover, an inner space of the first platen base 32A communicates with an inner space of the supporting member 33. Similarly, since the other platen bases include the bottom openings 322 which communicate with the supporting member 33, the inner space of the first platen base 32A, the inner space of the second platen base 32B, and the inner space of the third platen base 32C communicate with one another so that air in the inner portions can move.

The first platen 31A is slid in the plus direction of the Y-axis, and therefore, the first platen 31A is fitted on a portion of the upper portion of the first platen base 32A. Moreover, although not shown in FIG. 3, the second platen 31B is also adjacent to the first platen 31A and fitted. Thereby, at least a portion of the first platen 31A is provided on the first platen base 32A, and the second platen 31B is provided on the first platen base 32A and the second platen base 32B. Moreover, in the end of the first platen 31A and the end of the second platen 31B which are adjacent to each other on the first platen base 32A, the heights of the ends can be aligned.

Particularly, since the large-sized ink jet printer 1 shown in FIG. 1 is long in the paper width direction, the platen unit is configured by using the plurality of platen bases and the plurality of platens as described above. However, when the platen unit is configured of a plurality of platens, if steps occur between the platens, there is a problem in that the transported medium floats at the places. Moreover, if the steps occur, air leakage is generated in the steps, and there is a concern that adsorption of the medium may not appropriately be performed on the platen. Particularly, this becomes an obstacle to the transport of the rolled paper which is used with high frequency in the large-sized ink jet printer 1. However, in the configuration of the embodiment described above, since the height of the end of the first platen 31A and the height of the end of the second platen 31B can be aligned to each other, a step between both cannot be generated.

In the first platen 31A, a supporting surface 312 which supports the transported medium and grooves 313 for making the liquid such as the abandoned ink not to be in contact with the medium during the transport are provided. First suction holes 314 which serve for both the ink suction and the medium suction are provided in the grooves. The first suction holes 314 penetrate from the upper portion of the first platen 31A to the lower portion thereof (Z-axis direction). In addition, in the first platen 31A, a plurality of second suction holes 315 and a plurality of third suction holes 316 are provided on the supporting surface 312 which support the transported medium.

A sponge 34A (corresponding to a seal member) which is stretched and continuous is provided on an upper peripheral edge of the first platen base 32A. Moreover, in the first platen base 32A, a plurality of protruding portions 321 (corresponding to a second engagement portion) which protrude in the transport direction of the medium (X-axis direction) are provided (similarly, the protruding portions 321 are also provided in a direction (the minus direction of the X-axis) opposite to the transport direction of the medium).

A plurality of hook-shaped members 311 (corresponding to a first engagement portion) for engaging with the protruding portions 321 are provided in the first platen 31A. The hook-shaped members 311 are provided so as to straddle the sponge 34A of the first platen base 32A in the X-axis direction when the first platen 31A is mounted on the first platen base 32A. That is, the hook-shaped members 311 are provided so as to protrude to the outside of the first platen base 32A. The hook-shaped members 311 and the protruding portions 321 are provided at the same pitch as each other in the paper width direction and the plurality of hook-shaped members 311 are engaged with the corresponding protruding portions 321 respectively.

A plurality of stopping portions 325 which abut the supporting member 33 are provided on the bottom portion of the first platen base 32A. The centers of a portion of the plurality of stopping portions 325 are perforated, and the first platen base 32A is fixed to the supporting member by a fastening member such as a screw through the perforated holes. Moreover, the stopping portions 325 are provided at positions which overlap with portions (abutment portions) in which abutment surfaces (described below) of the protruding portions 321 and abutment surfaces of the hook-shaped members 311 contact each other in the paper width direction (Y-axis direction). In this way, the distances between the stopping portions 325 and the abutment surface can be decreased, and the height from the platen to the supporting member can be guaranteed with high accuracy.

Figure 5:
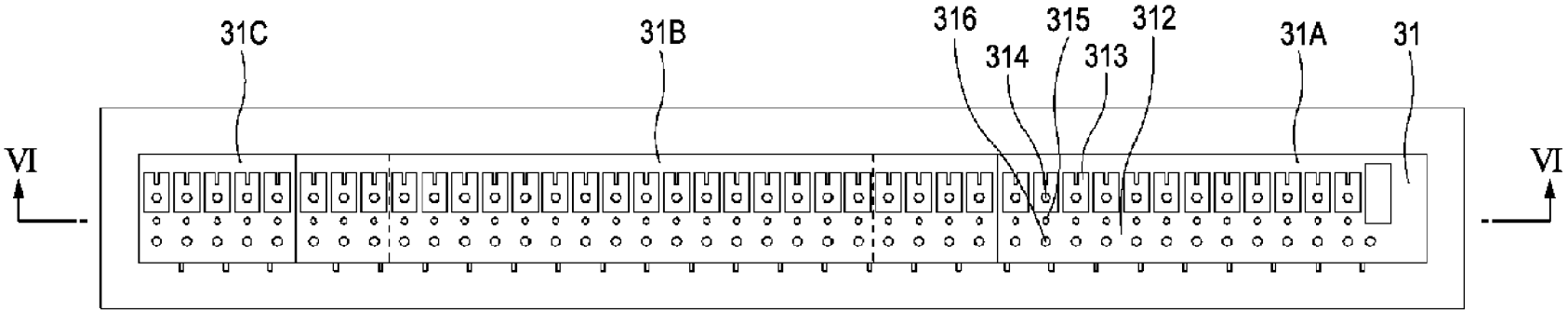
FIG. 5 is a top view showing the platen unit in the embodiment.
Figure 6:
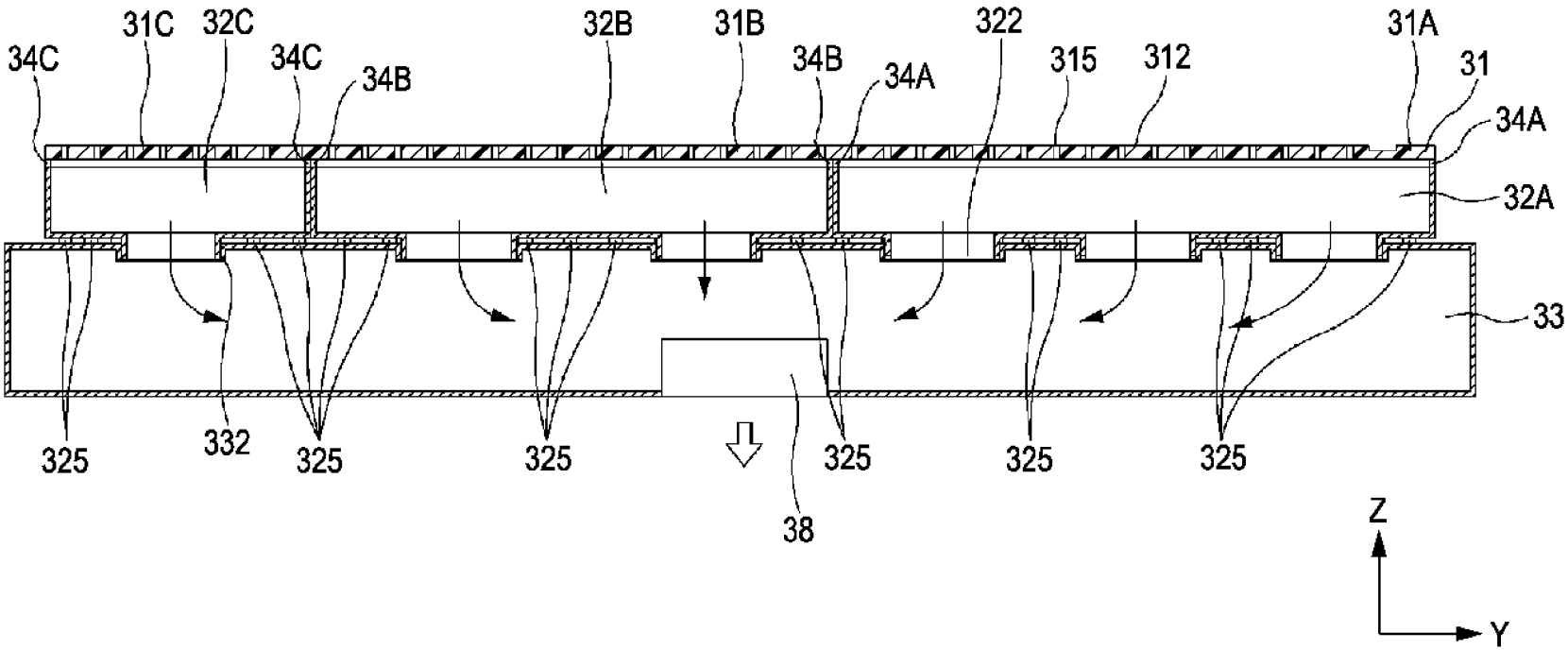
FIG. 6 is a cross-sectional view taken along a line VI-VI of the platen unit.

FIG. 5 is a top view showing the platen unit 30 in the embodiment. FIG. 6 is a cross-sectional view taken along a line VI-VI of the platen unit 30. FIG. 5 shows that the platen 31 includes the first platen 31A, the second platen 31B, and the third platen 31C. Moreover, FIG. 5 shows that the lengths in the paper width direction of the platens are different from one another. However, the numbers of the platens for configuring the platen unit are not limited to this. Moreover, the lengths in the paper width direction of the platens are not limited to this.

In FIG. 6, the first platen base 32A, the second platen base 32B, and the third platen base 32C are provided on the supporting member 33, and the first platen 31A, the second platen 31B, and the third platen 31C are provided on the platen bases.

The first platen base 32A, the second platen base 32B, and the third platen base 32C are fitted to the openings 332 of the supporting member 33 through the bottom openings 322. The lengths in the paper width direction (Y-axis direction) of each of the first platen base 32A, the second platen base 32B, and the third platen base 32C are different from one another.

A suction unit 38 is provided in a center bottom portion of the supporting member 30. The suction unit 38 discharges the air of the inner space which is configured by the platen 31, the platen base 32, and the supporting member 33 at the outer portion of the platen unit 30. Thereby, the air pressure of the inner space is maintained so as to be lower than the outside pressure. Therefore, the medium which is transported on the platen 31 is adsorbed on the platen through the first suction holes 314, the second suction holes 315, and the third suction holes 316 described above. In this way, since the medium is adsorbed on the planar platen, the surface of the medium also is maintained so as to be planar. Moreover, ink droplets can be ejected on the medium which is planarly maintained. Thereby, since the distance between the head and the medium can be uniformly maintained over the paper width direction and the transport direction, the ink droplets are landed on a desired position, and a printed matter having improved image quality can be provided.

As described above, the continuous and stretched sponge 34A is provided on the upper peripheral edge of the first platen base 32A. Similarly, a continuous and stretched sponge 34B is provided on the upper peripheral edge of the second platen base 32B and a continuous and stretched sponge 34C is provided on the upper peripheral edge of the third platen base 32C. The sponges are compressed in up and down directions (Z-axis direction) when the hook-shaped members 311 are engaged with the protruding portions 321 and the platen is fixed. That is, since the sponges are deformed and come into close contact with the platen base and the platen, airtightness between the platen base and the platen can be enhanced.

Figure 7A:
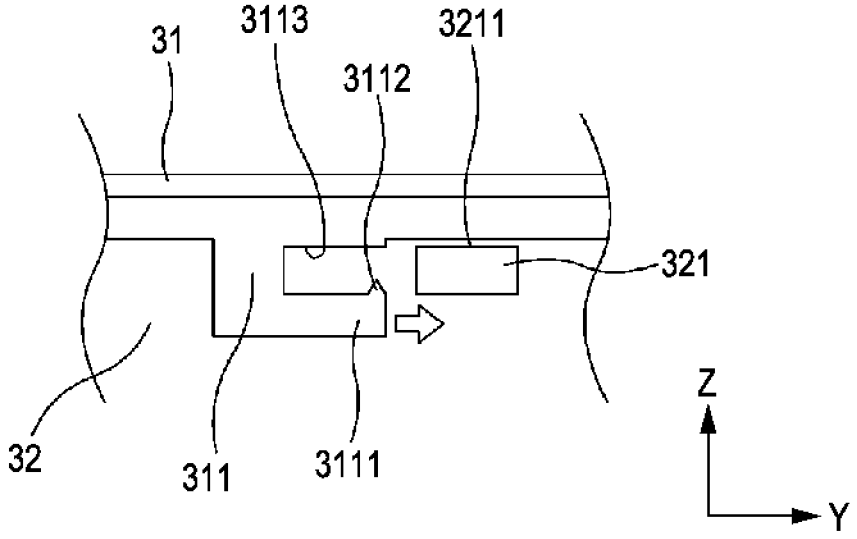
FIG. 7A is a first enlarged view showing a hook-shaped member of the platen and a protruding portion in the embodiment and FIG. 7B is a second enlarged view showing the hook-shaped member of the platen and the protruding portion in the embodiment.
Figure 7B:
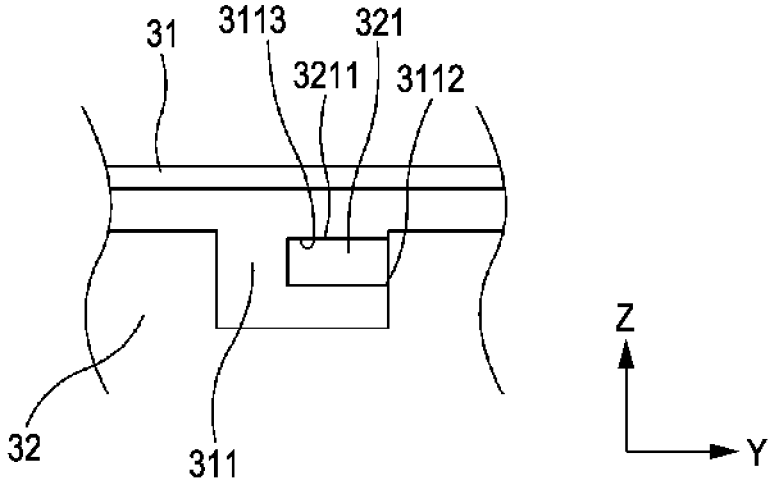

FIG. 7A is a first enlarged view showing the hook-shaped member 311 of the platen 31 and the protruding portion 321 in the embodiment, and FIG. 7B is a second enlarged view showing the hook-shaped member 311 of the platen 31 and the protruding portion 321 in the embodiment. Here, with reference to FIGS. 7A and 7B, the engagement between the hook shaped member 311 and the protruding portion 321 is described.

In FIGS. 7A and 7B, the protruding portion 321 and an abutment surface 3211 (corresponding to a first contact point) of the protruding portion 321 are shown. Moreover, in FIGS. 7A and 7B, a tip 3111 of the hook-shaped member 311 and a triangle-shaped elastic protrusion 3112 (corresponding to an elastic protrusion) which is provided in the tip 3111 are shown. In addition, in FIGS. 7A and 7B, an abutment surface 3113 (corresponding to a second contact point) of the hook-shaped member 311 which contacts the abutment surface 3211 of the protruding portion 321 is shown. A normal line to the abutment surface 3211 of the protruding portion 321 coincides with a normal line to the supporting surface 312. In addition, a normal line to the abutment surface 3113 of the hook-shaped member 311 also coincides with the normal line to the supporting surface 312.

Each platen slides on the platen base 32 in the paper width direction (the plus direction of the Y-axis), and therefore, the hook-shaped members 311 of the platen 31 are engaged with the protruding portions 321 of the platen base 32. When the protruding portions 321 are fitted to the hook-shaped members 311, the triangle-shaped elastic protrusions 3112 are elastically deformed. According to a pressing force due to the elastic deformation, the abutment surfaces 3211 of the protruding portions 321 are securely pressed to the abutment surfaces 3113 of the hook-shaped members 311.

In this way, since the abutment surfaces 3211 of the protruding portions 321 and the abutment surfaces 3113 of the hook-shaped members 311 securely contact each other, the heights from the stopping portions 325 of the platen base 32 to the supporting surface 312 of the platen 31 are guaranteed to the height on the design. Particularly, since the normal lines of the abutment surfaces 3211 of the protruding portions 321 and the normal lines of the abutment surfaces 3113 of the hook-shaped members 311 coincide with the normal line of the supporting surface 312, the abutment surfaces 3113 and 3211 securely contact each other according to the configuration, and therefore, the plane of the supporting surface 312 through which the medium passes can be guaranteed.

Moreover, since the plurality of hook-shaped members 311 and the plurality of protruding portions 321 are provided in the paper width direction, the heights from the stopping portions 325 of the platen base 32 to the supporting surface 312 of the platen 31 can be uniform over the entire area in the paper width direction.

Figure 8:
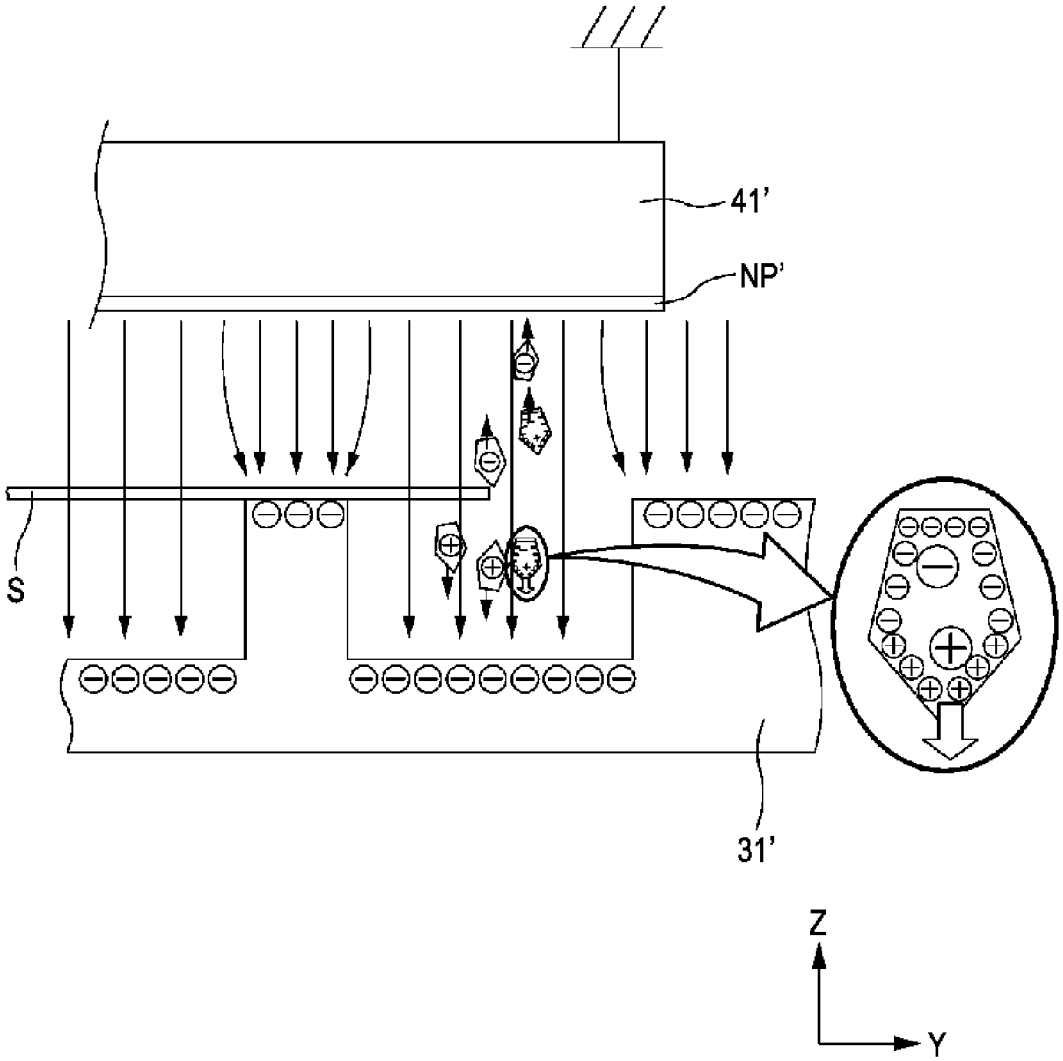
FIG. 8 is an explanatory diagram of an electric field when a platen is insulated.

FIG. 8 is an explanatory diagram of an electric field when a platen 31' is insulated. In FIG. 8, the platen 31' and a nozzle plate NP' of a head 41' are shown. Moreover, a sheet S is shown as the medium which is transported on the platen.

The head 41' becomes the same potential as the main body side through cables and is grounded. Therefore, the potential of the nozzle plate NP' is zero. On the other hand, when the platen 31' is not grounded, if the sheet S passes through the platen 31', static electricity is generated due to friction which is generated between the platen 31' and the sheet S.

Particularly, in the large-sized ink jet printer 1 like the embodiment, mostly, the sheet S having a wide width is transported in the paper width direction. In addition, in order to prevent the sheet S from floating from the platen 31', the sheet S is adsorbed from the above-described first suction holes 314 to the third suction holes 316. Thereby, the friction force between the sheet S and the platen 31' is increased, and the static electricity which is generated on the platen 31' is also increased. In this way, since the platen 31' is charged, if removal of the electricity is not performed, a potential difference between the head 41' and the nozzle plate NP' is generated and the electric field is generated.

On the other hand, when the sheet S passes, mostly, paper dust particles fly at the end of the sheet S. If the paper dust particles fly inside the electric field, as shown in FIG. 8, each of the paper dust particles are dielectrically polarized. The dielectrically polarized paper dust particles are adsorbed on the platen 31' or the nozzle plate NP'.

In the nozzle plate NP', nozzles (not shown) are provided and ink is ejected from the nozzles. However, if the paper dust particles are adsorbed on the nozzle plate NP', the paper dust particles generate clogging of the nozzles. Thereby, nozzles which cannot eject the ink are generated, desired dots are not formed in pixels in which the nozzles take charge of the formation of the dots (so-called dot omission is generated).

Cleaning of the nozzles is performed so that the dot omission is not generated. However, since the cleaning is performed by forcibly ejecting ink from the nozzles, the ink is needlessly wasted. Moreover, there is a disadvantage in that a discharging amount of a waste liquid is also increased due to the forced ejection of the ink. Therefore, it is preferable to prevent the paper dust particles from being attached on the nozzle plate NP'.

Figure 9:
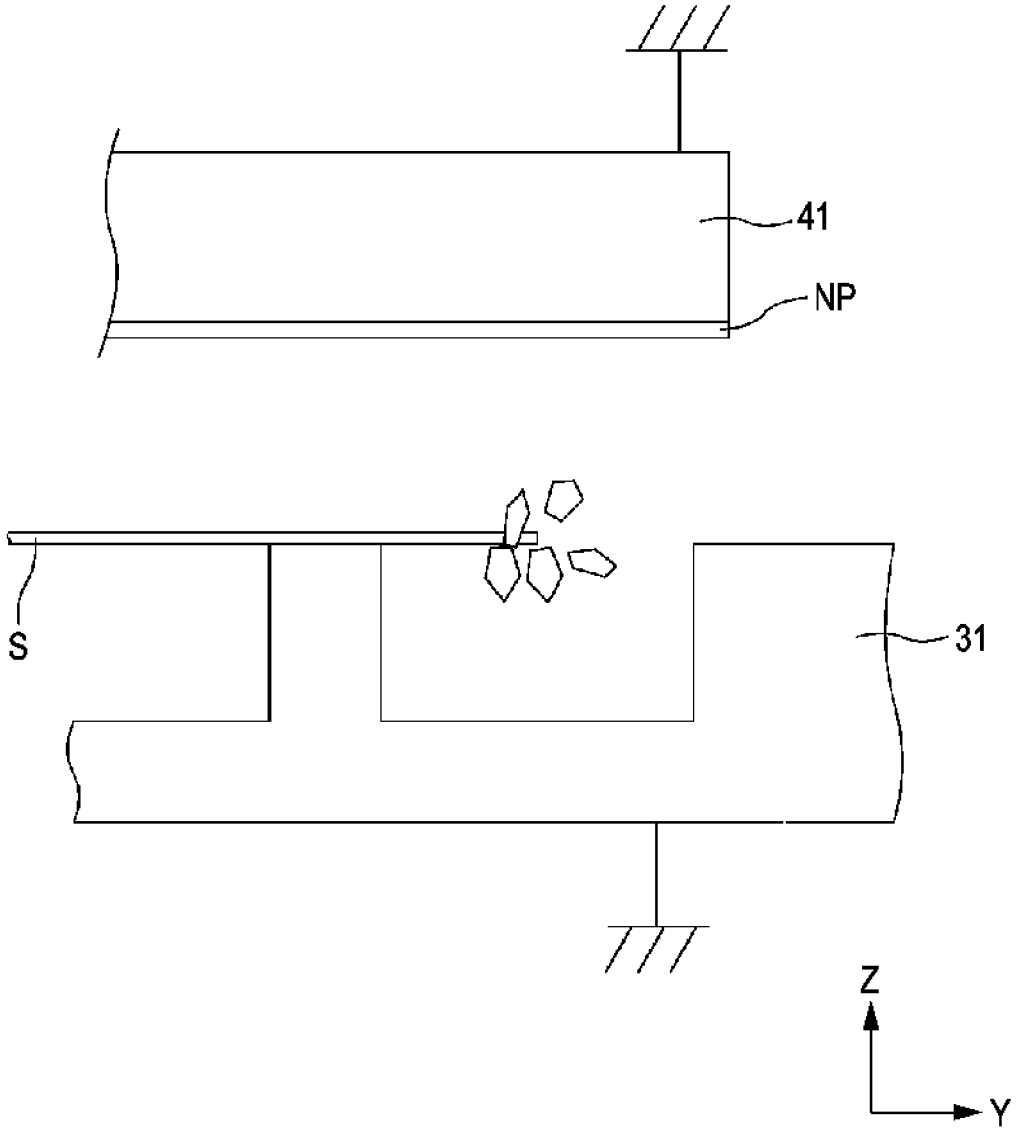
FIG. 9 is an explanatory diagram of an electric field when the platen is grounded.

FIG. 9 is an explanatory diagram of an electric field when the platen 31 is grounded. Considering the attachment process of the paper dust particles as described above, it is preferable to suppress the charging of the platen 31. Thereby, in the embodiment, the platen 31 is grounded through the platen base 32 and the supporting member 33 according to the above-described configuration (the supporting member 33 has the same electric potential as that of the ink jet printer 1).

As described above, the platen 31 and the platen base 32 are formed of a conductive resin. Moreover, in the platen 31 and the platen base 32, the hook-shaped members 311 and the protruding portions 321 are configured so as to securely contact each other. Moreover, the platen base 32 securely contacts the supporting member 33 which is formed of a sheet metal through the stopping portions 325.

According to the configuration, the electric charge of the platen 31 can be released through the platen base 32 and the supporting member 33. Thereby, since the electric field is not generated between the nozzle plate NP of the head 41 and the platen 31, the paper dust particles are not easily adsorbed on the nozzle plate NP. Moreover, the ink jet printer 1 in which the dot omission is not easily generated can be provided.

Moreover, according to the configuration in which the sponge is inserted between the platen 31 and the platen base 32, since the hook-shaped members 311 and the protruding portions 321 securely contact each other, even when the platen 31 is charged by static electricity or the like, the electric charge can be released to the supporting member side through the abutment surfaces.

In addition, when each of the platen bases is viewed as single unit, the abutment surfaces of the hook-shaped members 311 and the protruding portions 321 are aligned at equal intervals in the paper width direction (Y-axis direction). Moreover, according to this, the stopping portions 325 are also aligned at equal intervals. Thereby, even if the platen 31 is charged by static electricity or the like, the electric charge is dispersed and is rapidly removed through the abutment surfaces and the stopping portions 325.

Moreover, in the embodiment described above, the positions in which the hook-shaped members 311 and the protruding portions 321 are formed coincide with the positions in which the stopping portions are formed in the paper width direction. Thereby, the path in which the electric charge moves from the platen 31 to the sheet metal 33 can be the shortest, and the electric charge can be more rapidly released.

Other Embodiments

The above-described sponge is described as a general sponge. However, a conductive sponge may be used as the sponge. According to this, the electric charge which is charged on the platen 31 can be released to the platen base 32 and the supporting member 33 through the conductive sponge.

In the above-described embodiments, the printer 1 is described as the liquid ejecting apparatus. However, the invention is not limited to this and may be also realized in a liquid discharging apparatus which ejects or discharges fluids other than the ink (liquid, liquid material in which particles of functional materials are dispersed, or liquid material such as gel). For example, the technology similar to the above-described embodiments may be applied to various apparatuses, in which the ink jet technology is applied, such as a color filter manufacturing apparatus, a dyeing apparatus, a micro-fabrication apparatus, a semiconductor manufacturing apparatus, a surface processing apparatus, a three-dimensional modeling machine, a gas vaporizer, an organic electroluminescence manufacturing apparatus (particularly, a macromolecule electroluminescence manufacturing apparatus), a display manufacturing apparatus, a film formation apparatus, or a DNA chip manufacturing apparatus. Moreover, the methods of those or the manufacturing methods thereof also are within the scope of the range of the application.

The above-described embodiments are intended to facilitate the understanding of the invention and are not those which are interpreted to limit the invention. The invention can be modified and improved without departing from the gist, and it is needless to say that the invention may include the equivalents.

Head

The method ejecting the ink is not limited to the method which ejects the ink by using a piezoelectric element and may use other methods such as a method which generates bubbles in nozzles by heat.

What is claimed is:

1. A platen unit comprising:

a platen supporting member that includes an inner space, is formed of a conductive resin, and includes a first contact point;

a platen that is provided on the platen supporting member, is formed of a conductive resin, and includes a second contact point which contacts the first contact point.

2. The platen unit according to claim 1, wherein an elastic protrusion is provided in either a first engagement portion including the first contact point or a second engagement portion including the second contact point, the elastic protrusion is deformed when the first engagement and the second engagement are engaged with each other, and the first contact point and the second contact point contact each other.

3. The platen unit according to claim 1, wherein both the first contact point and the second contact point are provided at the same pitch with respect to the direction crossing the transport direction of the medium on the platen.

4. The platen unit according to claim 1, wherein the seal member is a conductive sponge.

5. The platen unit according to claim 1, further comprising a seal member that is provided between the platen supporting member and the platen.

6. The platen unit according to claim 5, wherein the first contact point is provided so as to protrude to the outside of the platen supporting member with respect to a transport direction of a medium on the platen, and the second contact point is provided so as to protrude to the outside of the platen with respect to the transport direction, and at least one of the first contact point and the second contact point straddles the seal member and contacts the outside of the seal member.

7. A liquid ejecting apparatus comprising:

a head that ejects liquid to a medium;

a platen supporting member that includes an inner space, is formed of a conductive resin, and includes a first contact point;

a platen that is provided on the platen supporting member, is formed of a conductive resin, and includes a second contact point which contacts the first contact point.

8. The liquid ejecting apparatus according to claim 7, further comprising a seal member that is provided between the platen supporting member and the platen.

* * * * *